United States Patent [19]

Hickerson

[11] Patent Number: 5,058,754

[45] Date of Patent: Oct. 22, 1991

[54] CHILD RESISTANT CONTAINER AND SAFETY CLOSURE

[76] Inventor: Frederick R. Hickerson, R.D. 6, P.O. Box 530, Newton, N.J. 07860

[21] Appl. No.: 623,018

[22] Filed: Dec. 6, 1990

[51] Int. Cl.[5] ..... B65D 50/00

[52] U.S. Cl. ..... 215/201; 215/218; 215/219; 215/221; 215/305

[58] Field of Search ..... 215/31, 201, 219, 221, 215/330, 335, 206, 305, 218, 329; 220/288

[56] References Cited

U.S. PATENT DOCUMENTS

| | | | |
|---|---|---|---|
| 3,233,769 | 2/1966 | Jessop | 215/217 X |
| 3,858,740 | 1/1975 | Lestaevel | 215/221 X |
| 4,002,258 | 1/1977 | Curry | 215/219 X |
| 4,512,484 | 4/1985 | Mar | 215/221 |
| 5,027,954 | 7/1991 | Hickerson | 215/201 |

FOREIGN PATENT DOCUMENTS

| | | | |
|---|---|---|---|
| 429214 | 5/1935 | United Kingdom | 215/31 |

*Primary Examiner*—Stephen Marcus
*Assistant Examiner*—Paul A. Schwarz

[57] ABSTRACT

A container for storing a hazardous product, a lock ring and a safety closure placed over the lock ring and threaded to the container. An extending tab portion of the lock ring extends from the bottom of an annular slot in the neck portion of the container. An extending neck portion of the container and a peripheral wall of the lock ring positioned over it, both have an offset axis displaced about the same distance from a central axis of the mating threads on the closure and the container. These offset axes are positioned in alignment to permit closure removal when an alignment bar portion of lock ring is in contact with a shoulder of the annular slot in the neck portion of the container. Serrations on the outside serrated surface of the lock ring and the inside serrated surface of the closure, are concentric with the threads on the closure and the container when the offset axes are in alignment. The serrations grip lock together when the offset axes go out of alignment, which occurs when the closure removal is attempted improperly. The proper procedure of holding the extending tab stationary to maintain alignment will allow unthreading and removal of the closure.

10 Claims, 6 Drawing Sheets

CHILD RESISTANT CONTAINER AND SAFETY CLOSURE

BACKGROUND OF THE INVENTION

This invention relates to a child resistant container and safety closure which furthers the "state of the art" of my child proof container and safety closure currently U.S. Pat. No. 5,027,954.

A variety of child resistant safety closures have been designed and marketed which are intended to prevent young children from opening containers of medicine and other potentially dangerous products. Most of these safety closures prevent accidental opening by children in accordance with their design features, but have a common problem of being difficult for adults to open, particularly the elderly and people who are physically handicapped.

For example, many child resistant container systems for aspirin and other medicines utilize arrows or other marks on the closure and container which must be aligned before the closure can be pryed off. These systems appear to work well to prevent accidental opening by children but are not considered to be adult easy, since the alignment marks are hard to see and/or feel, the closure is very tight on the container and difficult to rotate to the exact alignment point, and is also hard to pry off even after proper alignment. The push down and twist safety closure systems now on the market, also apparently good to prevent opening by children but because of the relatively high push and twist forces needed for opening, are not considered adult easy and are a real problem for the elderly and the handicapped. The above and other child resistant closure systems, which by design require relatively high forces in one direction or another, are difficult for adults to open. Because of this, an increasing number of adults purposely leave the closure off or loose on the container once it has been opened to avoid the annoyance of having to re-open it every time they want to use the contents. This procedure is considered dangerous to children as it defeats the purpose of child resistant container systems.

SUMMARY OF THE INVENTION

The main object of the present invention is to overcome the above problems and other disadvantages of child resistant container and safety closure assemblies now on the market by providing a simple and inexpensive assembly which enhances safety for the child and at the same time makes it easier for the adult, including the elderly and the handicapped, to remove the closure from the container.

A further object of the present invention is to provide a safety closure which can be removed from the container with a minimal force by following a simple removal procedure.

Still another object of the present invention is to provide a safety closure consisting of a small number of molded parts which can be simply molded and assembled by current manufacturing machinery and equipment with the result that the safety closure is of relatively low cost.

Yet another object of the present invention is for a sealing surface engagement between the container and closure which occurs at a location virtually free of mold parting lines, thus providing a reliable seal.

A further object of the present invention is to provide a safety closure that requires only minor modification to existing container neck designs in order to accomodate the lock ring and closure, such modification having little or not effect on the production cost of containers.

More particularly, the present invention is predicated upon the concept of providing a child resistant container and safety closure assembly utilizing a unique grip locking system. In this invention, a threaded closure engages a lock ring which is assembled over the neck of the container. The closure also seals the top of the container. To remove the closure, an extending tab on the bottom of the lock ring is held stationary by a finger on the hand holding the container while the closure is unthreaded from the container using the other hand. Attempting to remove the closure in a conventional manner, holding the container in one hand and manipulating the closure and/or the extending tab with the other hand, will be unsuccessful due to the jamming action of the grip locking system. To hold the lock ring on the neck of the container, a small groove on the inside of the lock ring mates with small beads on the outside of the container neck.

More particularly, in a preferred embodiment, the axis of the outlet of the extending neck portion of the container is offset slightly from the central axis of its threaded portion. A lock ring with a similar offset, between the axis of its inside peripheral wall and its outside serrated surface fits over the container's extending neck. Serrations on the inside serrated surface of the closure, which is threaded on to the container, are lightly engaged with the serrations on the outside serrated surface of the lock ring since the offset axis of both the lock ring and the container are held in alignment by a protruding alignment bar portion of the lock ring which extends from the bottom of the lock ring through an annular slot or indentation in the threaded neck portion of the container. When threading the closure to the container, the rear shoulder of the annular slot in the neck portion of the container contacts the alignment bar of the lock ring keeping the offset axes aligned with one another. This alignment allows the closure to rotate clockwise to the fully closed position with only a slight drag force created by the slight touching contact of the serrations on the closure slipping past the serrations on the lock ring. When an attempt is made to remove the closure in an improper manner, counterclockwise rotation of the closure without holding the extending tab of the lock ring stationary, the lightly contacting serrations on the lock ring and the closure will cause the lock ring to rotate slightly on the container, with resulting grip locking as the offset axis of the lock ring goes out of alignment with the offset axis of the container. The width of the annular slot in the neck of the container is sufficient to allow the needed relative movement between the lock ring and the container so that the alignment bar on the lock ring does not contact the opposite shoulder of the annualar slot. As additional force is applied when attempting to remove the closure incorrectly, the locking becomes even greater, preventing removal of the closure. To remove the closure once grip locking has occurred, the closure is simply retightened on the container by rotating it in a clockwise direction to realign the offset axes and allow the correct removal procedure to be followed. Although the serrated surfaces on the lock ring and closure are preferred, most any type surfaces, including ones that are smooth, will also provide the required grip locking.

One advantage of the present invention is that the removal of the safety closure when performed in the specified manner, requires an applied force approximately equal to the required force needed to open a conventional threaded closure. Thus, an adult who follows the specified procedure can readily remove the safety closure even though the adult may suffer from an affliction which limits the force he can apply to remove the safety closure.

Another advantage of the present invention is that accidental removal of the safety closure by young children is close to impossible since children will nearly always hold the container in one hand while attempting to open it. The reason children hold containers (bottles) is because as babies they start out holding nursing bottles, when older they play with toy bottles and the like, when older still they eat and drink foods from bottles and also observe the holding of common household bottles by family members and others. The grip lock system of the invention prevents opening of the safety closure when the container is hand held and the lock ring is allowed to rotate to cause lock gripping.

A still further advantage of the present invention is that the removal procedure for the closure does not require any special visual observations and can readily be performed in the dark and by persons with impaired vision.

Another advantage of the present invention is that in addition to the container only two molded parts are required, the closure and the lock ring, so that the invention may be economically manufactured.

Further objects and advantages of my invention will become apparent from a consideration of the drawings and ensuing description of it.

REFERENCE NUMERALS IN DRAWING

Figure 1:
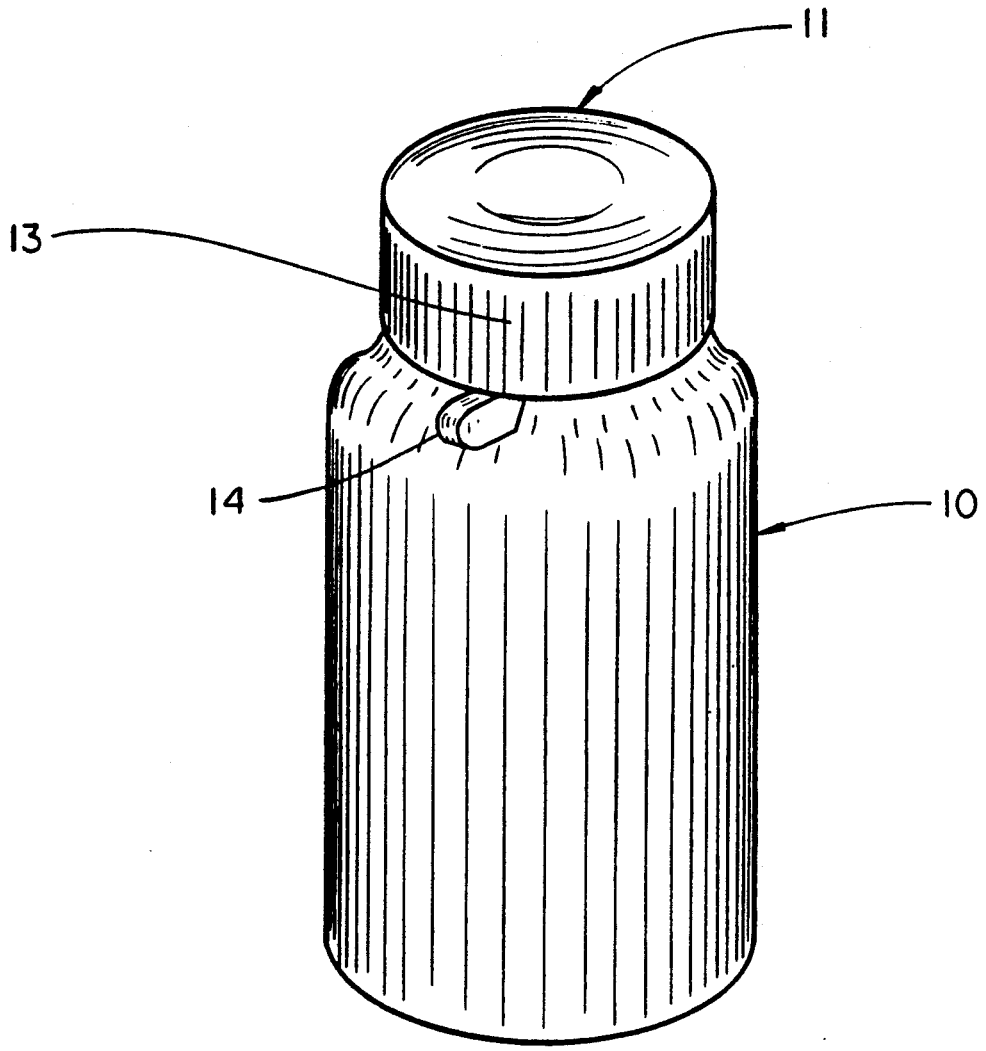
FIG. 1 is a perspective view of a child resistant container and safety closure embodying the invention.

10 container
11 safety closure
12 lock ring
13 corrugated surface
14 extending tab
15 neck portion
16 male thread
17 internal thread
18 peripheral wall
19 extending neck portion
20 peripheral wall
21 outside serrated surface
22 alignment bar
23 annular slot
24 shoulder
25 inside serrated surface
26 lip
27 flat surface
28 shoulder
29 small tooth
30 recess
31 beads
32 sealing disc

DESCRIPTION OF THE PREFERRED EMBODIMENTS

Figure 2:
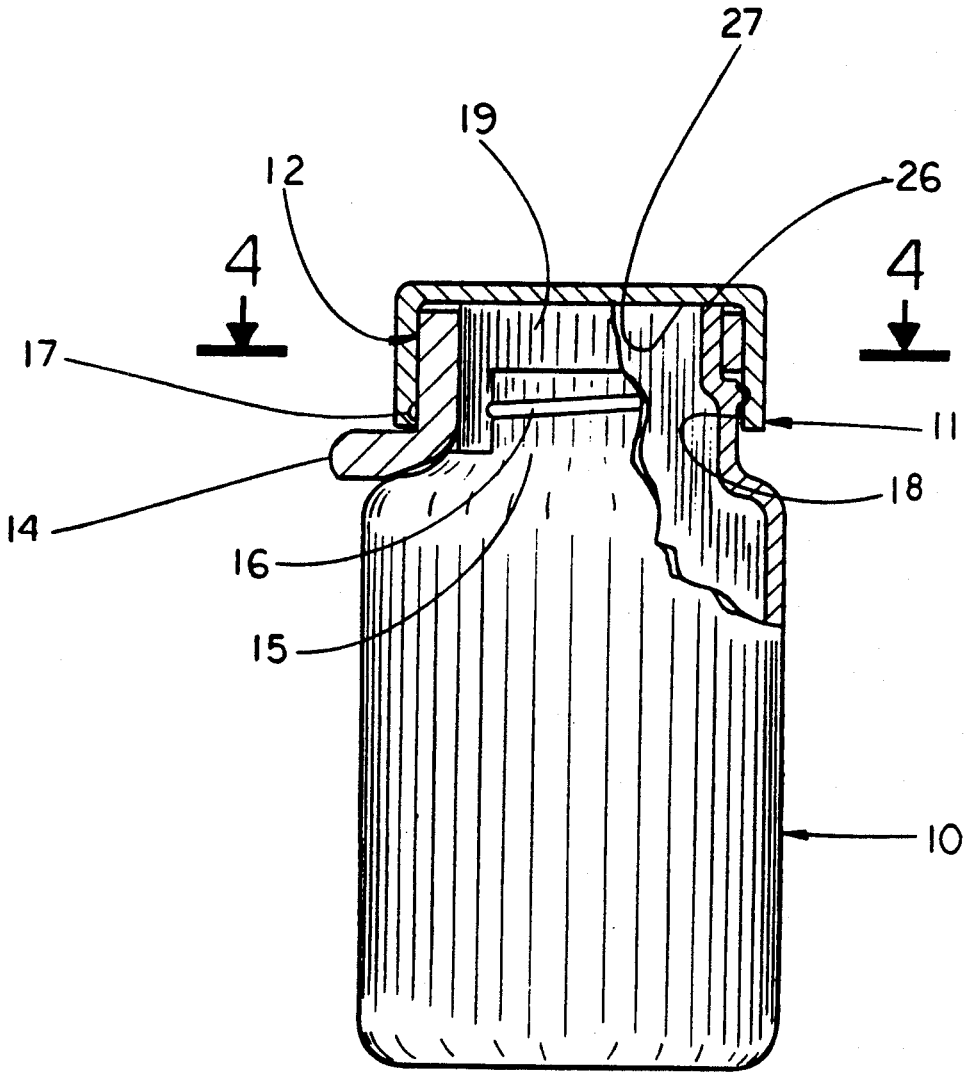
FIG. 2 is an exploded perspective illustrating the safety closure and lock ring attached to the container.
Figure 3:
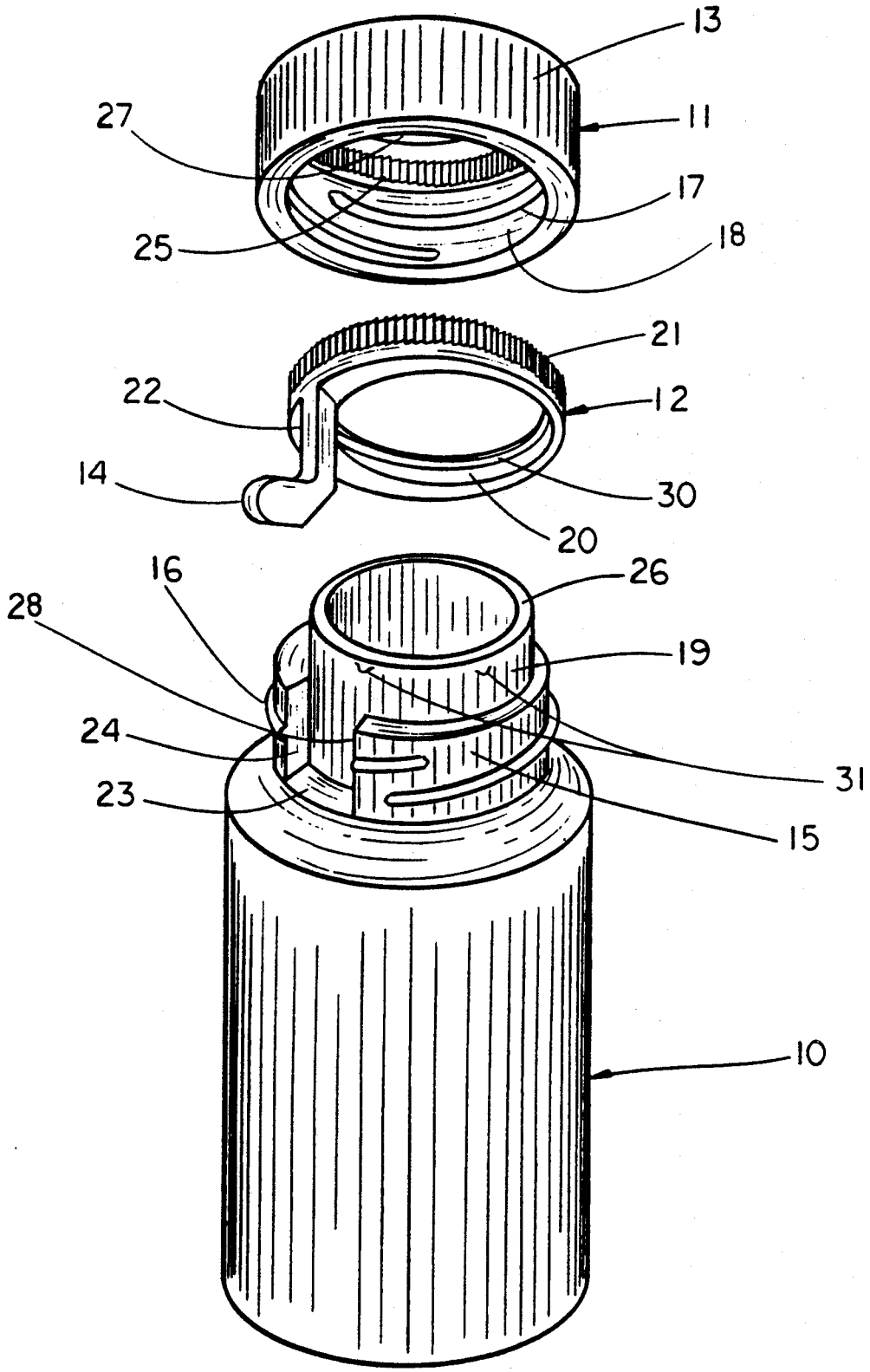
FIG. 3 is an exploded perspective illustrating the safety closure, lock ring with extending tab and container in accordance with the present invention.

Referring first to FIGS. 1-3, there is illustrated a dispensing container designated by numeral 10, preferably but not necessarily in the form of a molded plastic bottle, together with a safety closure 11 and an inner lock ring 12. Also illustrated, is a corrugated surface 13 on the outside periphery of the closure 11 for hand gripping during tightening and removal procedures. An extending tab 14, on the bottom of lock ring 12, is exposed and is designed to be held stationary during the closure 11 removal procedure.

As shown in FIGS. 2 and 3, the container 10 has a centrally located circular neck portion 15 which contains a male thread 16. An internal thread 17, located inside a peripheral wall 18 of the closure 11, is in the form of a groove extending about one and one half revolutions and is contoured to freely fit the male thread 16. Container 10 further has an extending neck portion 19, located on the top end of the neck portion 15, which is intentionally designed with its axis offset from the central axis of the male thread 16. The lock ring 12 is also designed to provide the same axis offset between the inside of a peripheral wall 20 and a peripheral outside serrated surface 21, as shown in FIG. 3. The peripheral wall 20 of the lock ring 12 fits over the extending neck portion 19 of the container 10. An alignment bar 22 on the lock ring 12 is positioned within an annular slot 23 in the extended neck portion 19 of the container 10. With the lock ring 12 attached to the container 10 and rotated clockwise, the alignment bar 22 will seat against a shoulder 24 of the annular slot 23 and the offset axes, described above for the lock ring 12 and the container 10, will be in alignment with each other in accordance with the design of the invention. In this alignment position, the serrations of the outside serrated surface 21 of the lock ring 12 will be concentric with an inside serrated surface 25 of the closure 11, and will allow the closure 11 to be threaded clockwise on the container 10, as the inside serrated surface 25 is designed to be concentric with the internal thread 17 of closure 11. A slight touching contact between the outside serrated surface 21 and the inside serrated surface 25, in the alignment position, is designed to create a slight contact during rotation of the closure 11 on the container 10. With the closure 11 threaded tightly to the container 10, sealing of the contents of the container 10 occurs as a lip 26 on the extending neck portion 19 seats on an inner flat surface 27 of the closure 11.

Figure 4:
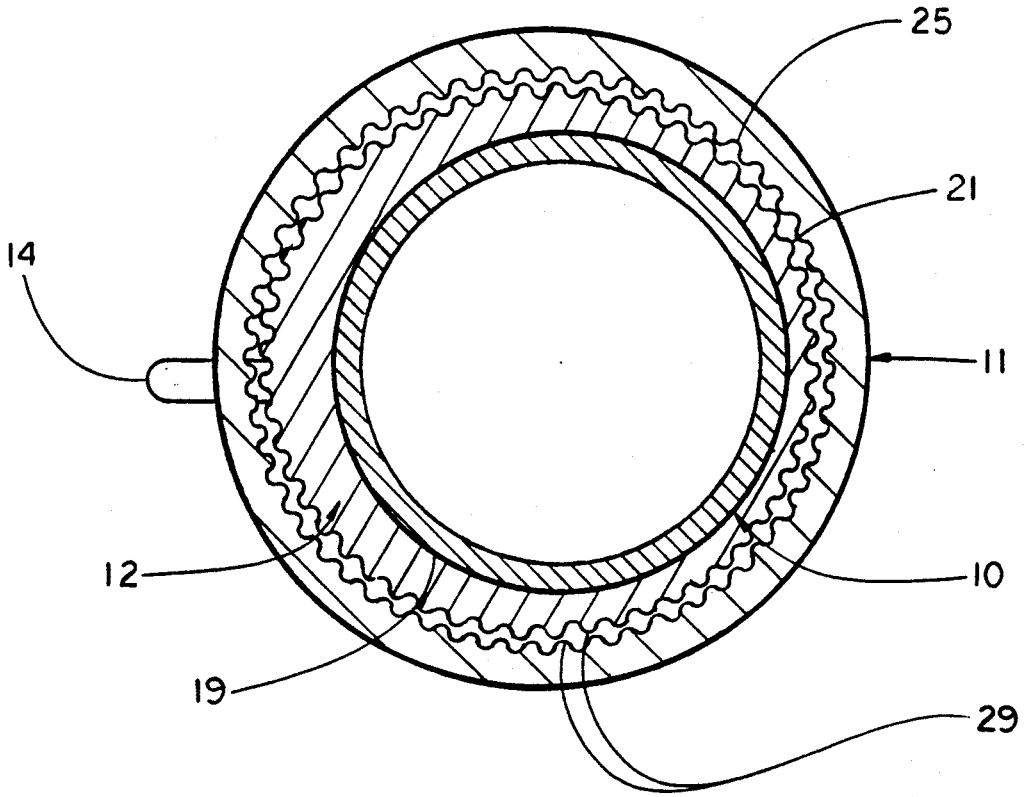
FIG. 4 is an enlarged cross sectional view taken along line 4—4 of FIG. 2 showing the aligned relationship of the safety closure, lock ring and container in its freely rotating or closed position.

FIG. 4. An enlarged cross sectional view taken along line 4—4 of FIG. 2, shows the concentric relationship of the closure 11, the lock ring 12 and the container 10 when the offset axes are at their alignment point which occurs when the alignment bar 22 is in contact with the shoulder 24 of the annular slot 23. In this position, serrations shown on the outside serrated surface 21 and the inside serrated surface 25 are concentric and lightly touch each other during rotation of the closure 11. As the closure 11 is threaded on the container 10, the lock ring 12 remains stationary on container 10 being held in the proper position by the alignment bar 22 being in contact with the shoulder 24. When unthreading the closure 11 from the container 10 in the proper manner, holding the extending tab 14 to prevent the alignment bar 22 from moving away from its contact with the shoulder 24, the slight contact of the serrations on the outside serrated surface 21 and the inside serrated surface 25 does not impede easy removal of the closure 11. When attempting to unthread the closure 11 from the container 10 in an improper manner, not holding the extending tab 14 of the lock ring 12 to maintain the alignment, the counterclockwise rotation to unthread the closure 11 will cause the lock ring 12 to rotate out of alignment on the container 10 into the safety or grip locking position, preventing removal of the closure 11 from the container 10. The lock ring 12 rotates because of the initial light contact between the serrations of the outside serrated surface 21 and the inside serrated surface 25.

Figure 5:
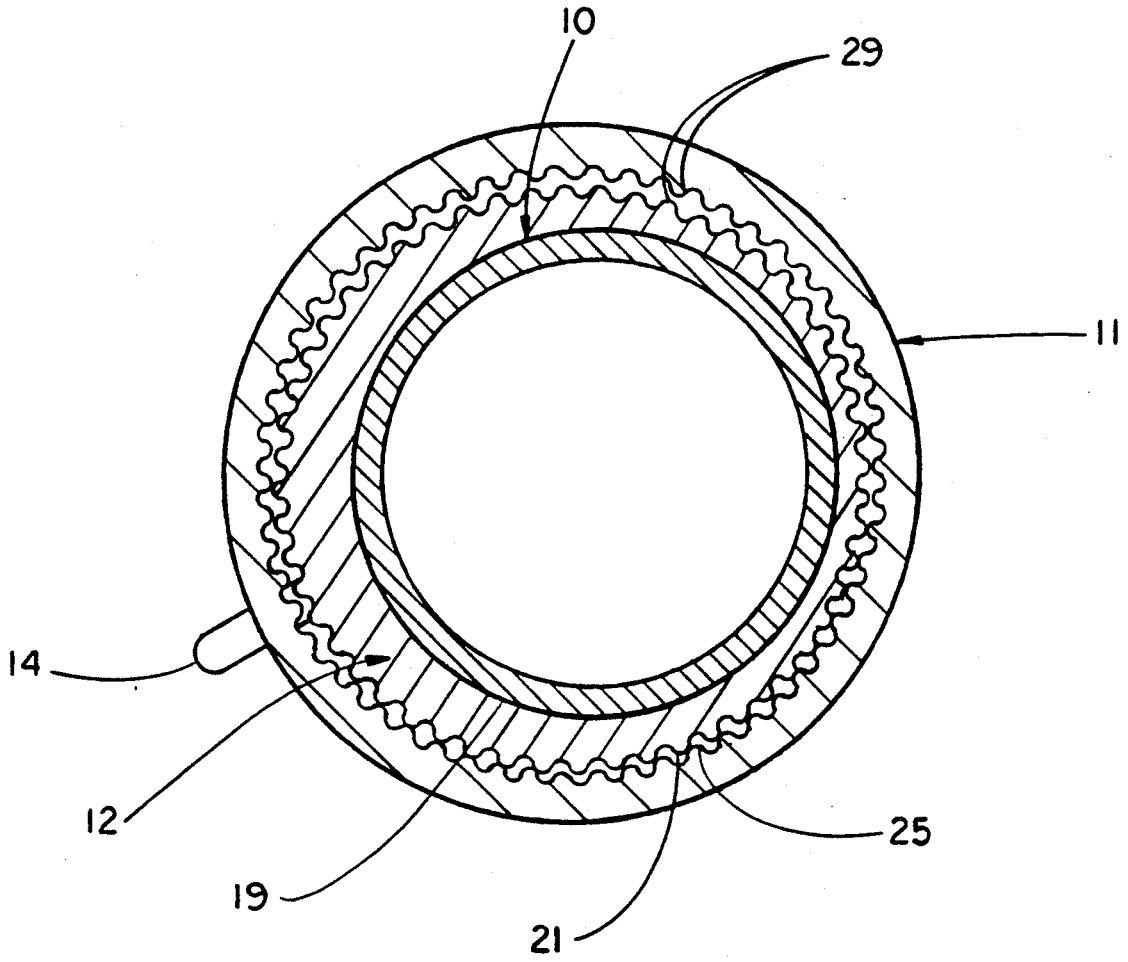
FIG. 5 is a view similar to FIG. 4 showing the relationship of these component parts in their safety grip locking position which prevents opening.

FIG. 5 shows the components in their safety or grip locking position in contrast with FIG. 4 which shows the components in their alignment position. In FIG. 5, a portion of the serrations of the outside serrated surface 21 and the inside serrated surface 25 are shown grip locked together, due to the movement of the alignment bar 22 toward a shoulder 28 of the annular slot 23 which has caused the offset axes to move off their alignment position, with the inside serrated surface 25 moving into an increasingly jamming or grip locking relationship with the outside serrated surface 21. In this grip locked position, additional force applied to unthread the closure 11 will result in increased jamming of the serrations and it will be impossible to remove the closure 11 from the container 10.

The configuration of the serrations, on both the outside serrated surface 21 and the inside serrated surface 25, is shown in the enlarged cross sectional views of FIGS. 4 and 5 as a relatively small tooth 29. While the preferred serrations would be highly advantageous, most any type of gripping surface will allow the grip locking relationship.

FIG. 3 further illustrates a securing means which allows the lock ring 12 to remain assembled to container 10 assuring continuation of the invention's child resistant feature. A continuous circumferential recess 30 on the inside peripheral wall 20 of the lock ring 12 is adapted to accomodate a plurality of circumferentially spaced laterally projecting beads 31 on the outside of the extending neck portion 19 of the container 10. The mating relationship of the beads 31 and the recess 30 will normally prevent removal of the lock ring 12 from the container 10 but will not significantly affect the ease of rotation.

Figure 6:
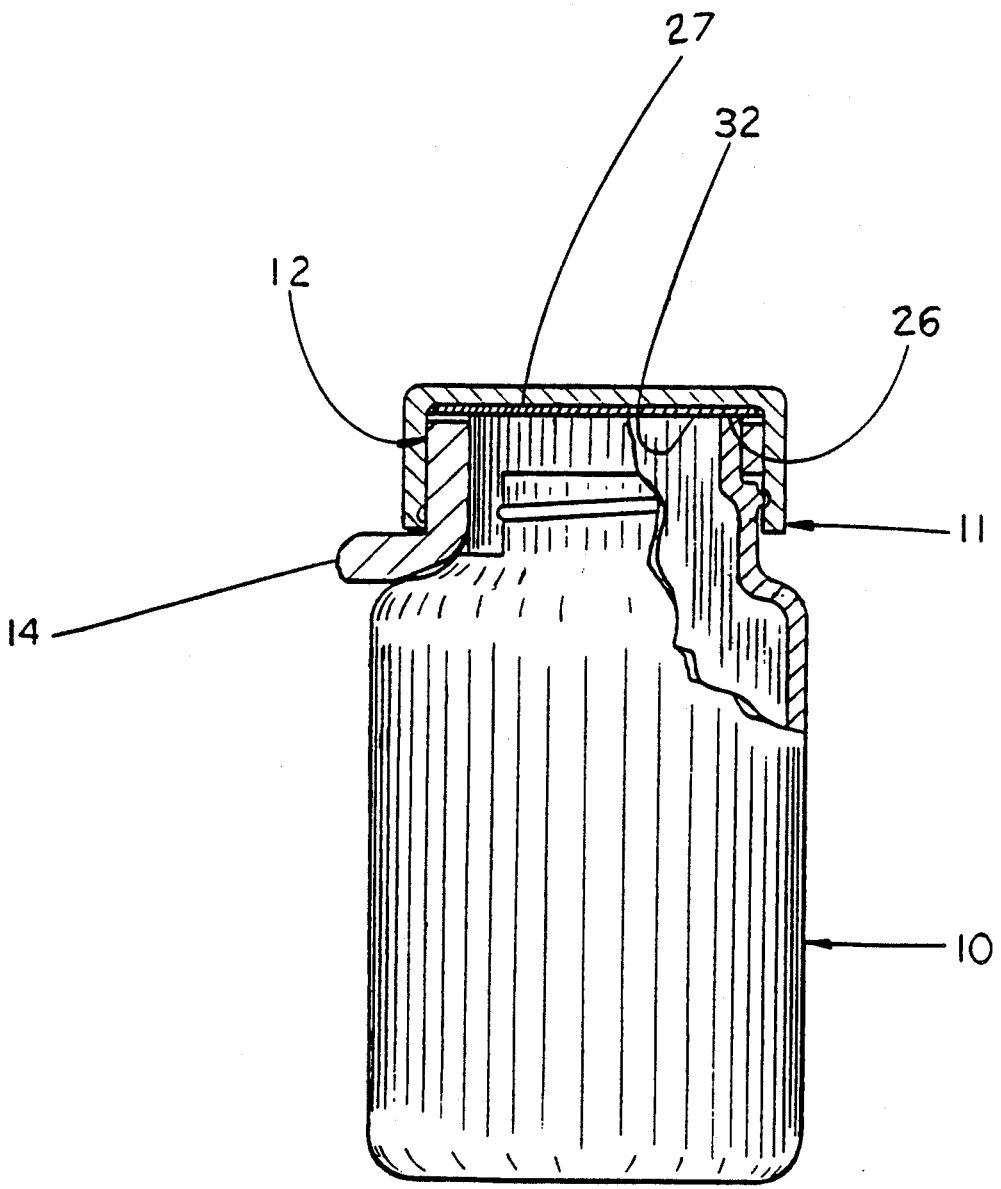
FIG. 6 is a vertical sectional view illustrating a sealing disc as an alternative embodiment of the invention.

FIG. 6 shows an alternate embodiment of the invention where a thin sealing disc 32 is included between the lip 26 and the inner flat surface 27 to enhance the sealing relationship between the container 10 and the closure 11.

Assuming that it is desired to apply the safety closure 11 to the container 10, FIGS. 1–3, a person assures that the alignment bar 22 of the lock ring 12 is in contact with the shoulder 24 of the extending neck portion 19 of the container 10. The closure 11 can then be threaded on to the container 10 by hand gripping the corrugated surface 13 and rotating it clockwise until the surface of the lip 26 on the container 10 and the flat surface 27 in the closure 11 contact in a sealing relationship. To remove the closure 11 from the container 10 in the proper manner, one must hold the exposed end portion of the extending tab 14 of the lock ring 12 to prevent its rotation and merely unthread the closure 11 in a counterclockwise direction. By holding the extending tab 14 stationary during closure 11 removal, the alignment bar 22 remains in contact with the shoulder 24 of the annular slot 23 maintaining the concentric alignment required to allow removal of the safety closure 11.

Assuming now the container 10, with the safety closure 11 attached, contains a harmful or dangerous medicine or other hazardous product, and is in the possesion of a child, his or her efforts to remove the closure 11 will be unsuccessful despite the various manipulations that will be tried. Holding the container 10 in one hand and trying to rotate the closure 11 in a clockwise direction will only tighten the threaded closure 11 more. Should the child try to unscrew the closure 11 by rotating it in a counterclockwise direction, the closure 11 and the lock ring 12 will rotate slightly into a jamming or grip locking relationship, FIGS. 3–5, and the closure 11 can not be removed until it is retightened on the container 10 and the proper opening procedure followed. The above grip locking relationship occurs because the contacting serrations on the outside serrated surface 21 of the lock ring 12 and the inside serrated surface 25 of the closure 11 causes the lock ring 12 to also rotate counterclockwise with the closure 11. As the lock ring 12 rotates, the alignment bar 22, in annular slot 23 moves away from the alignment position contact with shoulder 24 causing the offset axes to go out of alignment. With the offset axis of the extending neck portion 19 of the container 10 out of alignment with the offset axis of the peripheral wall 21 of the lock ring 12, the outside serrated surface 21 jams or grip locks with the inside serrated surface 25, FIG. 5.

As long as the child holds the container 10 in one hand and tries to manipulate the safety closure 11 and/or the extending tab 14 of the lock ring 12 in one direction or another, the closure 11 can not be removed. There is virtually no chance that the child will use a finger of the hand holding the container 10 to prevent the rotation of the extending tab 14, on the lock ring 12, to the grip locking position while attempting to remove the closure 11 with the other hand. Nearly all adults will also be baffled in their attempts to remove the safety closure 11 until the proper removal procedure is revealed to them. This removal procedure is truly adult easy, as the required force to remove the closure 11 is approximately equal to the force normally required to unthread closures from comparable regular non-child resistant container assemblies. The procedure is also extremely simple and can be accomplished quickly even in the dark.

The present invention will be economical to manufacture since there are only two relatively simple molded plastic parts in addition to the container 10 which can be made from plastic, glass or metal. These parts may be manufactured and assembled using current manufacturing methods, machinery and equipment.

Although the description above contains many specifics, these should not be construed as limiting the scope of the invention but as merely providing illustrations of some presently preferred emobodiments of this invention. For example, the securing means, which allows the lock ring 12 to remain assembled to the container, could be varied so that the recess 30 is in the outside of the extending neck portion 19 of the container 10 and the beads 31 on the inside peripheral wall 20 of the lock ring 12. Also beads 31 could be substituted by a small ridge which would mate the recess 30.

Thus the scope of the invention should be determined by the appended claims and their legal equivalents, rather than by the examples given.

I claim:

1. A child resistant container and safety closure comprising:

(a) a container for storing a hazardous product including a safety closure engagement means for attaching a safety closure to said container, wherein said closure engagement means defines a central axis, and an extending neck portion having an offset axis displaced a given distance from said central axis;

(b) a lock ring plated around said container extended neck portion including an inner peripheral wall portion defining an offset axis displaced said given distance from said central axis, an alignment bar extending downwardly from said lock ring, and a tab portion which extends outwardly from the bottom portion of said alignment bar;

(c) a safety closure having a downwardly depending cylindrical skirt for sealing said container, said closure positioned over said lock ring and said container and including a container engaging means for attaching said closure to said container;

(d) an alignment slot positioned below said extended neck portion of said container for aligning said offset axis of said extending neck portion into a concentric relationship with said offset axis of said locking inner peripheral wall and;

(e) a grip locking means positioned on said lock ring and said closure said grip locking means of said lock ring and said closure cooperating to prevent said closure removal when said lock ring inner peripheral wall is rotated into an out-of-concentric relationship with said extending neck portion of said container rotates out of alignment with said container.

2. The child resistant container and safety closure as defined in claim 1 wherein said annular slot further comprises a shoulder which projects inwardly toward said extending neck portion and engages said alignment bar to hold said offset axis of said extending neck portion in alignment with said offset axis of said peripheral wall of said lock ring.

3. The child resistant container and safety closure as defined in claim 1 wherein said grip locking means positioned on said lock ring and said closure comprises a serrated surface, said serrated surface positioned on an inner surface of said closure skirt and an outer surface of said lock ring.

4. The child resistant container and safety closure as defined in claim 3 wherein said serrated surfaces of said closures and said lock ring are relatively small teeth which grip lock together to prevent said closure removal from said container.

5. The child resistant container and safety closure as defined in claim 1 wherein the outer surface of said closure skirt is corrugated.

6. The child resistant container and safety closure as defined in claim 1 wherein said container, said closure and said lock ring are formed of a plastic material.

7. The child resistant container and safety closure as defined in claim 1 wherein said container is formed of glass.

8. The child resistant container and safety closure as defined in claim 1 wherein a sealing disc is provided between a flat surface inside said closure and a lip on said extending neck portion of said container.

9. The child resistant container and safety closure as defined in claim 1 wherein said inner peripheral wall of said lock ring cooperates with a plurality of circumferentially spaced lateral projecting beads which are positioned on an outer surface portion of said extending neck portion.

10. The child resistant container and safety closure as defined in claim 1 wherein said safety closure and container engagement means comprises an external male thread on a neck portion of said container and an internal thread on an inner peripheral wall of said closure skirt.

* * * * *